US006161370A

United States Patent [19]

Bertram

[11] Patent Number: 6,161,370

[45] Date of Patent: Dec. 19, 2000

[54] TRANSPORT BELTS FOR TRANSPORTING YARN

[75] Inventor: Tilman Bertram, Staetzling, Germany

[73] Assignees: Seil-Baur GmbH, Augsburg; Michael Hoerauf GmbH & Co. KG, Donzdorf, both of Germany

[21] Appl. No.: 09/201,888

[22] Filed: Nov. 30, 1998

[51] Int. Cl.[7] ..... D02G 3/02

[52] U.S. Cl. ..... 57/210; 57/207; 57/211; 57/214; 57/224; 57/230; 57/231; 428/222; 34/462; 34/466; 34/271; 28/271

[58] Field of Search ..... 57/207, 210, 211, 57/214, 224, 230, 231, 237, 243; 428/222; 34/645, 462, 466; 28/271

[56] References Cited

U.S. PATENT DOCUMENTS

| | | | |
|---|---|---|---|
| 1,975,923 | 12/1930 | Christiansen | 57/211 |
| 3,451,305 | 3/1967 | Christiansen | 57/210 |
| 5,233,821 | 8/1993 | Weber, Jr. et al. | 57/224 |
| 5,248,548 | 9/1993 | Toon | 428/222 |
| 5,557,862 | 9/1996 | Vetter et al. . | |
| 5,809,861 | 9/1998 | Hummel | 57/230 |

FOREIGN PATENT DOCUMENTS

4415229A1 11/1995 Germany .

*Primary Examiner*—John J. Calvert
*Assistant Examiner*—Mary K. Fiore
*Attorney, Agent, or Firm*—Evenson, McKeown, Edwards & Lenahan, P.L.L.C.

[57] ABSTRACT

An endless transport belt made of thermoresistant synthetic filaments for transporting yarn is described, which yarn is wound around a plurality of transport belts in the form of loops, said transport belts being arranged polygonal in cross section. In order to reduce stretching of the transport belt, at least one reinforced thread is included among the synthetic filaments, which reinforced thread is preferably a steel wire or cord.

26 Claims, 2 Drawing Sheets

Fig. 1
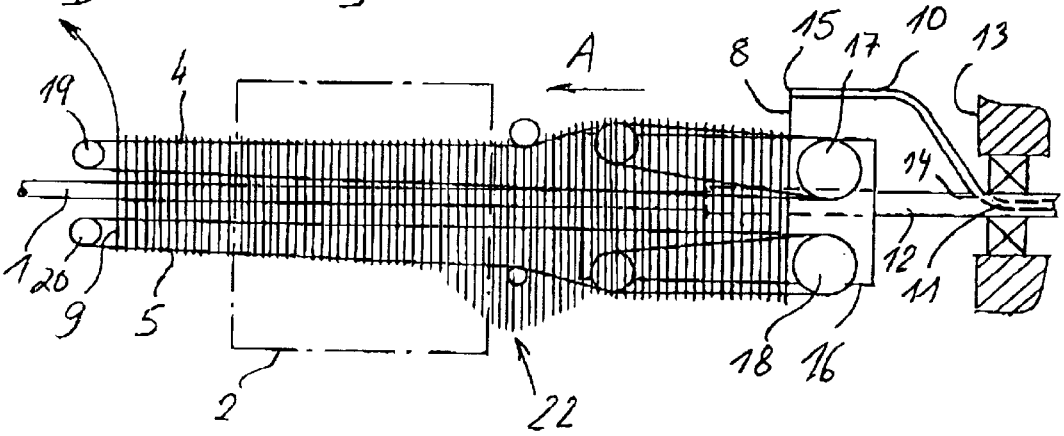
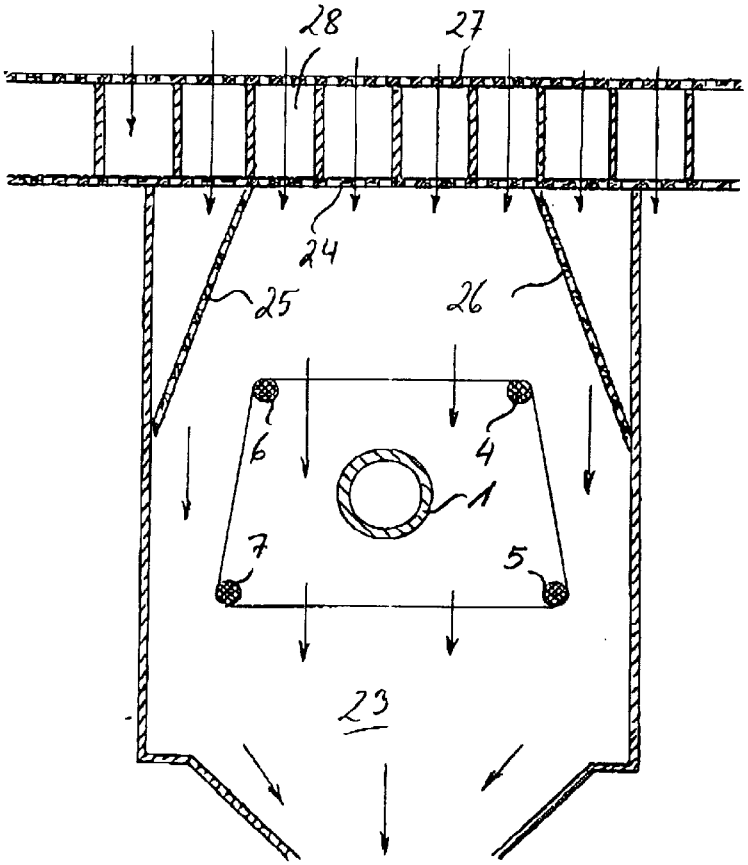
Fig. 2

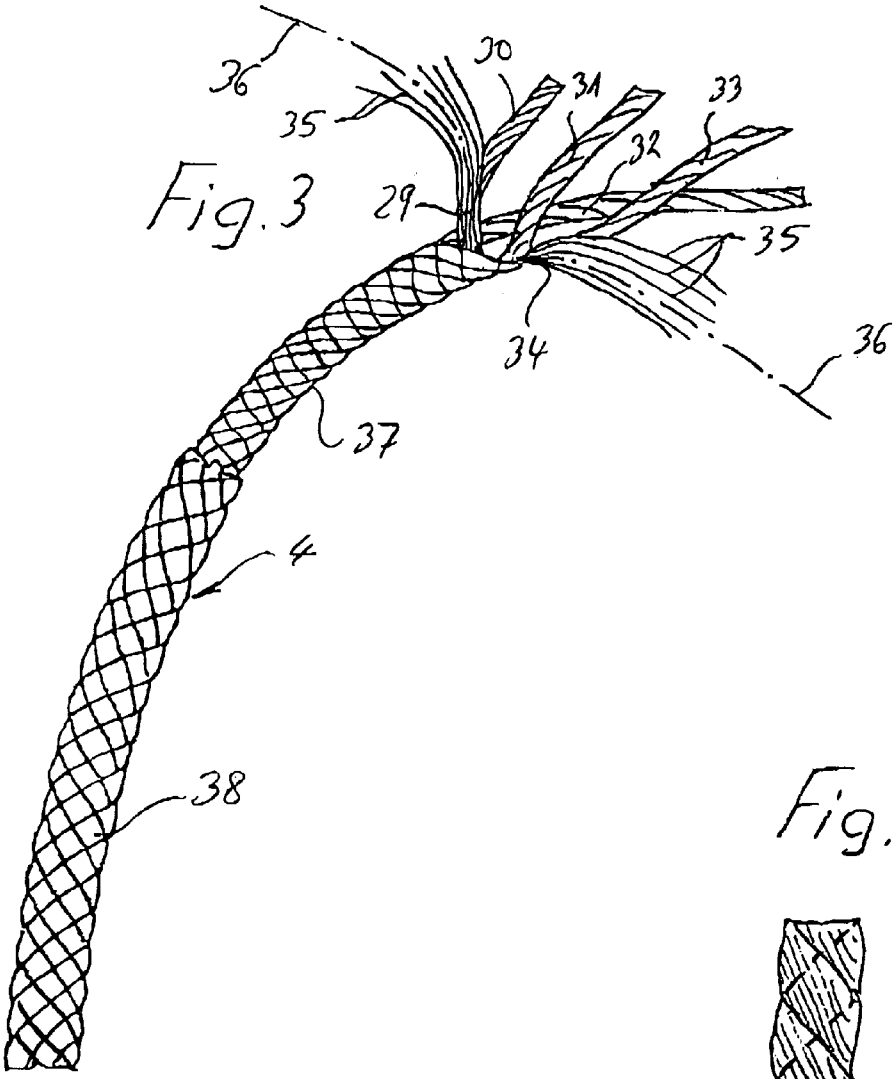
Fig. 3
Fig. 4
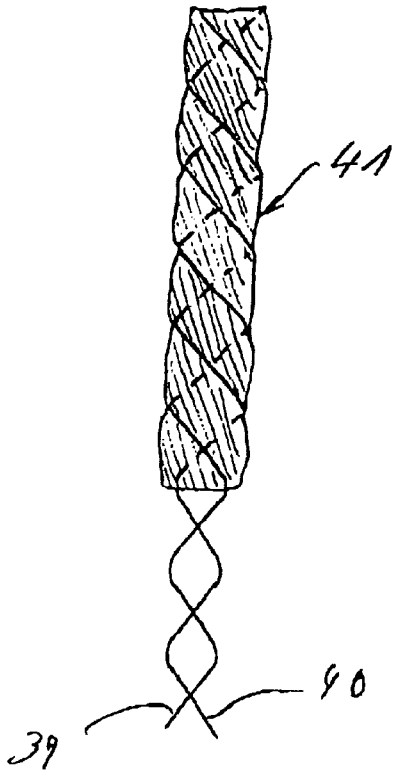

TRANSPORT BELTS FOR TRANSPORTING YARN

BACKGROUND AND SUMMARY OF THE INVENTION

The present invention relates to an endless transport belt made of thermoresistant synthetic filaments for transporting yarn, which yarn is wound around a plurality of transport belts in the form of loops, said transport belts being arranged polygonal in cross section.

Transport belts of this type are applied in yarn conditioning plants which comprise a heat setting chamber in which, for example, carpet yarns are heat-set at temperatures nearing 200° C. The temperature present in the heat setting chamber lies significantly above the necessary heat setting temperature. In order to ensure that the heat setting temperature is reached even at difficult points along the yarn, the heat setting chambers have, over the years, become longer and longer. In U.S. Pat. No. 5,557,862, for example, in which transport belts of the above mentioned type are used, a length of the heat setting chamber of 5 m is disclosed. As the transport belts extend over longer areas upstream and downstream of the heat setting chamber, and in addition, circulate, the belts can reach lengths of up to 20 m.

As a result of the polygonal arrangement of, for example, four transport belts, around which the yarns are wound in the form of loops before they enter the heat setting chamber, the belts experience a high tension load. Thus the transport belts, in particular in the case of long heat setting chambers, are stretched to an extent that is detrimental to the operation of the yarn conditioning plant.

It is an object of the present invention to create an endless transport belt for application in the above mentioned case, which transport belt is able to cope with the high tension load and whose stretch rate lies below 1%.

This object has been achieved in accordance with the present invention in that at least one reinforced thread is added to the synthetic filaments in order to reduce the stretching of the transport belt, the modulus of elasticity of the reinforced thread being only slightly lower than that of steel.

Transport belts usually used in the industry are made of chemical fibres, for example aramide fibre composites, which belts have a round cross section of approximately 7 mm. In the case of the present invention, one or more reinforced threads, for example four in the form of steel wires or cords, are added to the chemical fibre composites, which influence the stretch tendency of the entire transport belt in such a positive way that the entire extent of the stretch remains below 1%, even at high temperature loads. The reinforced thread may consist of an aramide fibre composite comprising stainless steel fibres.

The low-stretch, thermoresistant transport belts must have a suitable surface structure for transporting yarns. The surface must, on the one hand, be sufficiently smooth, so that the yarns are not damaged, while on the other hand, they must have sufficient friction for the required yarn transport. When the reinforced thread is a steel one, then it should be located in the interior of the transport belt and in no case on its surface. Furthermore, the steel thread must, of course, be made of stainless steel. Due to the additional bending load which occurs when the transport belt turns around, the steel thread experiences a constant alternating load, which can easily mean ten million load alternations during its lifetime. The reinforced thread must be able to withstand this load. In order that the belt material can be made into an endless transport belt, both ends must be capable of being spliced together in such a way that the diameter of the transport belt does not alter at the splice point and that the necessary tensile strength is transferred to the splice point.

The transport belt according to the present invention can be produced in a variety of ways, for example as an endless plaited belt by means of loops plaited over one another, or by means of stranding, whereby a cladding is wound around a core. In a preferred embodiment of the present invention, a clad-core-plait is provided for the transport belt, whose plaited form of the cladding, as well as of the core, permits splicing. For a reinforced thread, at least one wire cord made of Niro wire filaments is preferably worked into the core plait, which can be a cross or loop plait. Two to twenty four steel threads are possible, depending on the plaiting.

In the case of a clad-core transport belt having a circular or quadratic cross section, which is plaited from a plurality of wire threads and a plurality of synthetic filaments, the core is plaited from fibres having a high friction coefficient, whereby in a preferably even number of strands, one or a plurality of wire threads is stranded or plaited in long lay or in reverse lay with the fibres towards the strand.

Alternatively, it is possible that the reinforced thread or threads are entire braided layers, which are applied between the core and the braided cladding.

The present invention achieves the aim of creating a friction and a form closure also at the ends, joined together by splicing, by means of the combination of chemical fibres with a high friction coefficient, and the reinforced thread, preferably in the form of a fine wire, so that without a direct connection of the reinforced fibres, a longitudinal stability arises even at high temperatures and under load.

BRIEF DESCRIPTION OF THE DRAWINGS

These and further objects, features and advantages of the present invention will become more readily apparent from the following detailed description thereof when taken in conjunction with the accompanying drawings wherein:

FIG. 1 is a side view of a transport device of a yarn conditioning plant comprising a transport belt, FIG. 2 is an enlarged version of FIG. 1 showing the polygonal arrangement of four transport belts in the cross section of the yarn conditioning plant, FIG. 3 is an enlarged perspective view of a transport belt according to the present invention in the form of a clad-core plait, FIG. 4 is a cabled transport belt.

DETAILED DESCRIPTION OF THE DRAWINGS

The yarn conditioning plant according to FIGS. 1 and 2 comprises a plurality, preferably of four to six, adjacently arranged central masts 1, of which only one central mast 1 is shown in the Figures. Each central mast 1 is a component part of a transport device, which is guided through a heat setting chamber 2 (denoted only by a dot-dash line) having a temperature of approximately 200° C. The central mast 1 is supported in a holding device (in FIG. 1 at its right-hand end), and at the other end it projects freely, or is additionally supported from below by a supporting device (not shown).

Each central mast 1 is equipped with four transport belts 4,5,6 and 7, of which only two transport belts 4 and 5 are visible in FIG. 1. These transport belts 4 to 7, are, as can be seen in particular in FIG. 2, arranged in a polygonal pattern around the central mast 1. They each serve to transport in transport direction A at least one yarn 8, which is wound around the central mast 1 and the transport belts 4 to 7 in the form of loops 9. Preferably a plurality of yarns or ply yarns 8, for example, four or six per central mast 1, can also be provided. This arrangement serves to transport the largest possible amount of yarn 8 at a predetermined dwell time continuously through the heat setting chamber 2.

The depositing of the loops 9 occurs by means of a winding flyer 10, which is arranged in the area of the supported end of the central mast 1. The winding flyer 10 begins in a shaft 12 having an axial bore hole 11, which shaft 12 is supported coaxially to the central mast 1 in a housing 13. The axial bore hole 11 runs into a radial opening 14 of the shaft 12 and graduates into a crank-like, hollow winding flyer 12, which is driven, together with the shaft 12, to rotate.

The yarn 8 to be transported is fed in transport direction A through the axial bore hole 11 and exits out the mouth 15 of the winding flyer 10. Due to the rotational movement of the winding flyer 10, the yarn 8 is wound around the transport belts 4 to 7, which preferably have a round cross section.

A gear housing 16 is supported on the shaft 12, which gear housing 16 comprises the drive for the transport belts 4 to 7. The holding device mentioned above for the supported end of the central mast 1 is provided in the gear housing 16.

Driven upper and lower pulleys 17 and 18 for the transport belts 4 to 7 are provided at the gear housing 16. In the area of the outwardly projecting end of the central mast 1, freely rotatable upper and lower pulleys 19 and 20 for the transport belts 4 to 7 are arranged to the pulleys 17 and 18. Shortly before they reach the pulleys 19 and 20, the loops 9 of the yarn 8 are straightened, withdrawn according to arrow direction B and fed to a winding machine (not shown). The pulleys 19 and 20 are supported in a way that permits their distance from one another to be regulated; this is carried out by means of a tension device (not shown).

Before the heat setting chamber 2 is reached, the above mentioned polygon of the transport belts 4 to 7 is reduced by means of tension discs or the like, so that the shrinking of the yarn 8 which occurs in the heat setting chamber 2 is taken into consideration. For this reason, it is denoted in FIG. 1 that the loops 9 in the entry area 22 of the heat setting chamber 2 hang down freely from the lower transport belts 5 and 6 and only then, when they are inside the heat setting chamber 2 a while, shorten to such an extent that they are again disposed on the transport belts 4 to 7.

As can be seen in particular from FIG. 2, there is a so-called trapezoid channel 23 for each central mast 1, whose cross section is trapezoidal and which essentially consists of perforated metal sheets 24, 25 and 26 surrounding the transport belts 4 to 7. In the cross section of the heat setting chamber 2, a plurality of such trapezoid channels 23 are arranged adjacently to one another. By means of these trapezoidal channels 23, a so-called three-way ventilation is achieved for the loops 9 of yarn 8.

Above the perforated sheet 24 covering the trapezoidal channels 23, there is a number of orientation channels 28, upstream of which in turn a further perforated sheet 27 is arranged. This arrangement serves the orientation of the air circulation (in a way not further shown) and is denoted by arrows.

As can be seen in particular in FIG. 1, the transport belts 4 to 7 are very long, in particular in the case of long heat setting chambers 2. Also, the transport belts 4 to 7 are exposed to a very high temperature inside the heat setting chamber 2. Finally, the transport belts 4 to 7 are put under a high tension from the wound loops 9 of yarn 8. In the case of standard transport belts this has resulted in stretching to such an extent where it is no longer acceptable for the efficient operation of the yarn conditioning plant.

In order that, even at high temperatures and high tension, the transport belts transporting the yarns 8 do not stretch more than 1%, the transport belts 4 to 7 are reinforced in a way described below.

In FIG. 3, a part of a transport belt 4 according to the present invention is perspectively shown. While other types of production of transport belts may be possible, FIG. 3 shows only the embodiment preferred by the applicants.

The transport belt 4 shown comprises in its interior a plurality for example, of six or eight, strands 29 to 34, which in turn comprise a plurality of synthetic filaments 35. These synthetic filaments 35 may well vary in structure, although preferably aramide fibres are used. The synthetic filaments 35 should be scratch resistant, highly thermoresistant and chemically very stable. As can be further seen from FIG. 3, each strand 29 to 34 comprises in addition to the synthetic filament 35 a reinforced thread 36, which is denoted by a dot-dash line. The strands 29 to 34 have a slight protective twist, as can be seen from the strands 30 to 33. For graphical reasons, the strands 29 and 34 are untwisted, so that the synthetic filaments 35 and the reinforced threads 36 are recognizable.

In the case of the reinforced threads 36, steel threads are preferably involved here, which have the form of a wire or a cord. They must be completely rust-free and must not slip against the synthetic filaments 35. They should not be visible on the surface of the transport belt 4, so that the yarn 8 to be transported does not come into contact with them.

The six strands 29 to 34 in the present case are plaited endlessly into a core plait 37, which may be a cross or loop plait.

The core plait 37 is located in turn in a plaited cladding 38, whereby there is no direct fixation between the core plait 37 and the cladding 38, so that the cladding 38 can be slid away from the core plait 37 in order that the ends can be spliced.

In FIG. 4 it is schematically shown that alternatively to the manufacture of a transport belt 41, two strands 39 and 40 can be cabled together. A stranding is also possible, in which a strand is wound around a core.

Each strand 39,40 consists here also of a plurality of synthetic filaments as well as at least one reinforced thread, whose modulus of elasticity, insofar as the reinforced thread is not made of steel, should not be very much lower than that of steel. Both strands 39 and 40, are provided with a protective twist, before they are in turn cabled or stranded as shown in FIG. 4.

In the making of the transport belt 4 to 7 or also 41, two open ends arise, which must be spliced together (in a way not shown as this is generally known), so that endless transport belts 4 to 7 or 41 are created. During splicing, however, the diameter must remain unchanged, and the necessary tension must be exactly transferred.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An endless transport belt for transporting yarn wound in loops around a plurality of transport belts forming a polygonal cross-section, said transport belt comprising:

a plurality of thermal resistant synthetic filaments wound together, and at least one reinforced thread extending along the synthetic filaments to reduce stretching of the composite belt formed by the synthetic filaments and the at least one reinforced thread, said at least one reinforced thread being disposed in an interior part of the belt such as not to contact loops of yarn transported by the belt during use thereof.

2. A transport belt according to claim 1, wherein the least one reinforced thread is twisted with at least one of the synthetic filaments.

3. A transport belt according to claim 1, wherein the at least one reinforced thread is a steel thread having a stainless steel surface.

4. A transparent belt according to claim 3, wherein the steel thread is invisible from outside the belt.

5. A transport belt according to claim 1, wherein the transport belt is made by means of cabling or stranding the synthetic filaments with the at least one reinforced thread.

6. A transport belt according to claim 1, wherein the transport belt is made by means of plaiting.

7. A transport belt according to claim 6, wherein the transport belt consists of a plurality of strands having a slight protective twist, at one of the strands comprises at least one reinforced thread, and said strands each comprising a plurality of synthetic filaments.

8. A transport belt according to claim 7, wherein the strands are plaited with one another.

9. A transport belt according to claim 8, wherein the plaited strands form a core plait, which is surrounded by a plaited cladding.

10. A transport belt according to claim 3, wherein the steel thread is one of a wire cord and a wire filament.

11. A transport belt according to claim 10, wherein at least four steel threads are provided.

12. A transport belt according to claim 1, wherein the stretch rate of the transport belt in practical operation lies under 1%.

13. A transport belt according to claim 2, wherein the at least one reinforced thread is a steel thread having a stainless steel surface.

14. A transport belt according to claim 4, wherein the transport belt is made by means of cabling or stranding the synthetic filaments with the at least one reinforced thread.

15. A transport belt according to claim 4, wherein the transport belt is made by means of plaiting.

16. A transport belt according to claim 4, wherein the steel thread is one of a wire cord and a wire filament.

17. A transport belt according to claim 7, wherein the stretch rate of the transport belt in practical operation lies under 1%.

18. A method of making an endless transport belt for transporting yarn wound in loops around a plurality of transport belts forming a polygonal cross-section, said method comprising:

connecting a plurality of thermal resistant synthetic filaments together, adding a least one reinforced thread to the synthetic filaments to reduce stretching of the composite belt formed, by the synthetic filaments and the at least one reinforced thread, disposing said at least one reinforced thread in an interior part of the belt such as not to contact loops of yarn transported by the belt during use thereof.

19. A method according to claim 18, wherein the at least one reinforced thread is twisted with at least one synthetic filament.

20. A method according to claim 18, wherein the at least one reinforced thread is a steel thread having a stainless steel surface.

21. A method according to claim 20, wherein the steel thread is invisible from outside the belt.

22. A method according to claim 18, wherein the transport belt is made by means of cabling or stranding the synthetic filaments with the at least one reinforced thread.

23. A method according to claim 18, wherein the transport belt is made by means of plaiting.

24. A method according to claim 18, wherein the stretch rate of the transport belt in practical operation lies under 1%.

25. A method of making an endless transport belt for transporting yarn wound in loops around a plurality of transport belts forming a polygonal cross-section, said method comprising:

connecting a plurality of thermal resistant synthetic filaments together, adding a least one reinforced thread to the synthetic filaments to reduce stretching of the composite belt formed by the synthetic filaments and the at least one reinforced thread, wherein the stretch rate of the transport belt in practical operation lies under 1%.

26. An endless transport belt for transporting yarn wound in loops around a plurality of transport belts forming a polygonal cross-section, said transport belt comprising:

a plurality of thermal resistant synthetic filaments wound together, and at least one reinforced thread extending along the synthetic filaments to reduce stretching of the composite belt formed by the synthetic filaments and the at least one reinforced thread, wherein the stretch rate of the transport belt in practical operation lies under 1%.

* * * * *